United States Patent [19]

Miura

[11] 4,189,915

[45] Feb. 26, 1980

[54] SECONDARY AIR SUPPLY SYSTEM FOR AN INTERNAL COMBUSTION ENGINE

[75] Inventor: Motohisa Miura, Toyota, Japan

[73] Assignee: Nippondenso Co., Ltd., Kariya, Japan

[21] Appl. No.: 900,308

[22] Filed: Apr. 26, 1978

[30] Foreign Application Priority Data

Apr. 28, 1977 [JP] Japan ..... 52-49410

[51] Int. Cl.[2] ..... F01N 3/10

[52] U.S. Cl. ..... 60/290; 60/277

[58] Field of Search ..... 60/276, 290, 289, 277

[56] References Cited

U.S. PATENT DOCUMENTS 3,906,723 9/1975 Matumoto ..... 60/290

3,996,739 12/1976 Ono ..... 60/290

*Primary Examiner*—Douglas Hart

*Attorney, Agent, or Firm*—Cushman, Darby & Cushman

[57] ABSTRACT

An air switching valve for controlling supply of secondary air to an exhaust system of an engine closes an air release port thereof to increase an amount of secondary air to be supplied at least at an initial stage of an engine acceleration operation. The air switching valve closes a secondary air supply line to stop the supply of the secondary when the engine acceleration operation continues for more than a predetermined time period, thus to prevent an exhaust gas purifier disposed in the exhaust system from over-heat.

5 Claims, 2 Drawing Figures

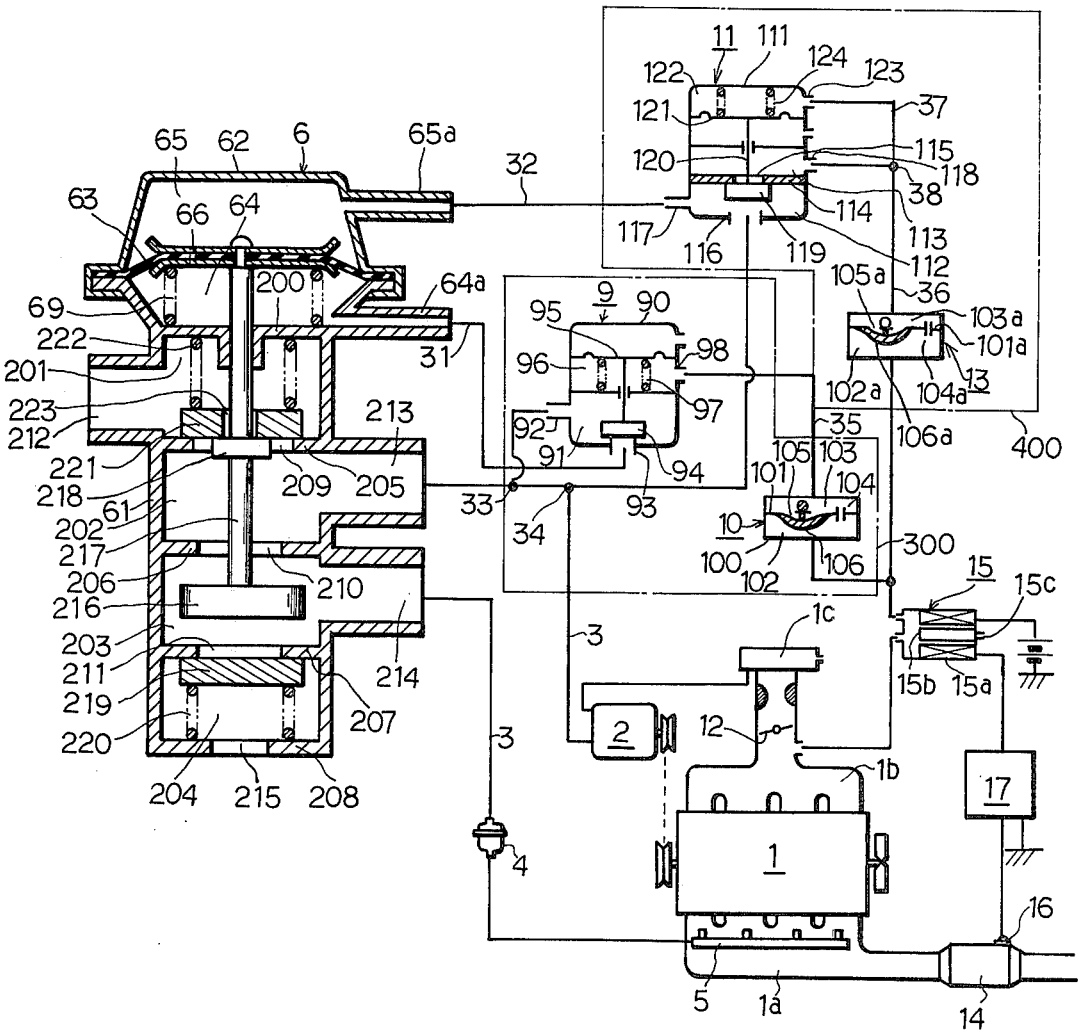
11
111
124
123
122
121
37
120
115
118
38
114
113
117
116
119
112
105a
36
103a
101a
13
102a
104a
106a
400
65
62
6
65a
32
63
66
64
200
64a
69
222
31
201
223
212
213
221
218
209
205
61
202
217
206
210
216
203
211
214
219
207
220
204
215
208
9
90
95
98
96
97
92
91
94
93
33
34
35
105
103
101
104
10
100
102
106
300
15
15c
15b
15a
1c
3
2
12
1b
17
1
4
16
5
1a
14

SECONDARY AIR SUPPLY SYSTEM FOR AN INTERNAL COMBUSTION ENGINE

BACKGROUND OF THE INVENTION

1. Field of the Invention

The present invention relates to a system for supplying secondary air into an exhaust system of an internal combustion engine and, more particularly, to a system for controlling the secondary air supply.

2. Description of the Prior Art

The heretofore known secondary air supply control system comprises a relief valve operative to maintain the pressure of the air in a secondary air supply line below a predetermined value and also comprises an air switching valve operative to direct the air from an air pump selectively to the engine exhaust system or back into an air cleaner in accordance with the engine operating conditions. The relief valve used therein is generally designed to be opened to release the pressurized air from the air supply line at a relatively low pressure level so as to increase the operative life of the air pump.

The percentages of HC and CO contents of engine exhaust gases, in general however, are increased when engine speed is abruptly accelerated or decelerated. The solution to the increase in the HC and CO emission at the engine acceleration relied substantially entirely upon the secondary air supply, although the solution to the HC emission increase at the engine deceleration relied upon other control systems. At the engine acceleration, therefore, it was required to supply the secondary air into the engine exhaust system as much as possible. However, because the relief valve in the secondary air supply line was opened to release the secondary air into atmosphere when the secondary air pressure exceeded the predetermined level, as discussed above, the engine exhaust system was not supplied with a sufficient amount of secondary air during engine acceleration operation despite the fact that the air pump was operated to discharge sufficient amount of secondary air.

SUMMARY OF THE INVENTION

It is an object of the present invention to provide a secondary air supply control system which is operative to supply secondary air into an engine exhaust system at an increased rate at an abrupt engine acceleration operation.

It is another object of the present invention to provide a secondary air supply control system which is operative to momentarily interrupt the secondary air supply in the case where the engine acceleration operation has lasted for more than a predetermined time period.

BRIEF DESCRIPTION OF THE DRAWING

The accompanying drawing diagrammatically illustrates an embodiment of a secondary air supply system according to the present invention.

DETAILED DESCRIPTION OF PREFERRED EMBODIMENT

Referring to the drawing, an internal combustion engine 1 having a conventional intake system **1*b* with a throttle valve 12 therein and an exhaust system 1*a* is shown as being equipped with a secondary air supply system according to the invention. The system includes an air pump 2 driven by the engine 1 through an endless belt and pneumatically connected to an air cleaner 1*c* at the inlet of the engine intake system 1*b*. A secondary air supply line 3 comprising conventional conduits extends from the air pump 2 and terminates in an air injection nozzle 5 through which secondary air from the air pump 2 is supplied into an exhaust manifold of the engine 1. A check valve 4 of a conventional structure is provided in the line 3 to prevent exhaust gas flow through the line 3 toward the air pump 2. An air switching valve 6 is also provided in the secondary air supply line 3 between the air pump 2 and the check valve 4**.

The air switching valve 6 comprises a housing formed by two housing parts 61 and 62 hermetically secured together with a diaphragm 63 disposed therebetween to define with the housing parts first and second air pressure chambers 64 and 65. A small orifice 66 is formed in the diaphragm 63 to communicate the first chamber 64 with the second chamber 65. A first compression coil spring 69 is disposed in the first chamber 64 and extends between the first housing part 61 and the diaphragm 63 to resiliently bias the same away from the first housing part (in an upward direction in the drawing). The first and second chambers 64 and 65 are provided with air ports **64*a* and 65*a* formed in the first and second housing parts, respectively. The air ports 64*a* and 65*a* are respectively pneumatically connected with first and second control air supply lines 31 and 32 having upstream ends pneumatically connected to the secondary air supply line 3 at points 33 and 34 both upstream of the air switching valve 6**.

On the side of the first air pressure chamber 64 remote from the second air pressure chamber 65, the housing part 61 defines therein a generally cylindrical space which is divided by first to third partition walls 205 to 207 into four chambers 201 to 204, which are referred to as first to fourth chambers, as will be described in more detail later. The chambers 201 to 204 are axially generally aligned with the chambers 64 and 65. Each of the partition walls 205 to 207 has a respective opening 209, 210 or 211, through which opposed chambers are adapted to communicate with each other. Each of the partition walls 205 to 207 acts as a valve seat as described later. Each of chambers 201 to 204 respectively has ports 212 to 215, wherein the first and fourth ports 212 and 215 are opened to the atmosphere. The second port (secondary air inlet) 213 and the third port (secondary air outlet) 214 are connected to the upstream and downstream parts of the secondary air supply line 3, respectively. The second and third chambers 202 and 203, therefore, act as a part of the secondary air supply line when the secondary air inlet and outlet 213 and 214 are in communication with each other. The communication between the inlet and outlet is controlled by a first valve member 216 disposed in the third chamber 203, which is connected to the diaphragm 63 by a valve stem 217 which extends movably through the chambers 64, 201 and 202 and sealingly through a partition 200 so that, when the diaphragm 63 is deformed downwardly, as viewed in the drawing, against the first spring 69, the first valve member 216 is moved toward the third partition wall 207, to thereby open the opening 210. When the diaphragm 63 is deformed upwardly, the valve member 216 is moved toward and into sealing engagement with the second partition wall 206 acting as a valve seat, to thereby close the opening 210.

A second valve member 219 is disposed in the fourth chamber 204 being resiliently urged toward the third partition wall 207 by a second spring 220 so that the opening 211 formed on the partition wall 207 is normally closed.

The second valve member 219 opens the opening 211 when the pressure of the air in the third chamber 203 exceeds a predetermined value (generally around 0.3 kg/cm$^2$), so that a portion of air in the third chamber 203 may be released to the atmosphere through the opened opening 211, the fourth chamber 204 and the fourth port 215 to thereby maintain the pressure in the third chamber 203, that is in the secondary air supply line, within the limited range.

A third valve member 221 is disposed in the first chamber 201 and resiliently urged by a third spring 222 against the first partition wall 205 acting as a valve seat, so that the opening 209 formed on the wall 205 is normally closed.

The valve stem 217 extends through an opening 223 formed on the third valve member 221 and is formed with an annular stopper 218 on the lower side of the valve member 221. Under the normal steady running of the engine 1, where the pressures in the first and second air pressure chambers 64 and 65 are equal to each other because of the provision of the orifice 66, the valve stem 217 is urged upwardly by the spring 69 until the annular stopper 218 abuts on the undersurface of the third valve member 221 as shown in FIG. 1. In this embodiment, the third spring 222 is stronger than the first spring 69 so that under the above normal steady running of the engine, the third valve member 221 remains seated on the valve seat 205 closing the opening 209.

The supply of air pressure from the air pump 2 into the first air pressure chamber 64 of the air switching valve 6 is controlled by a first air pressure supply controlling means 300 which includes an on-off valve 9 disposed in the first air supply line 31. The on-off valve 9 comprises a valve housing 90 defining therein a first chamber 91 provided with a first port 92 connected to the point 33 of the secondary air supply line 3 and a second port 93 connected to the first air pressure chamber 64 of the air switching valve 6. A valve member 94 is disposed in the first chamber 91 of the valve 9 for movement into and away from sealing engagement with an annular valve seat provided around the inner peripheral edge of the port 93 to thereby control the communication between the secondary air supply line 3 and the first air pressure chamber 64 of the valve 6. The valve member 94 is mechanically connected to a valve actuator which, in the illustrated embodiment, comprises a diaphragm 95 which defines with the valve housing 90 a vacuum chamber 96 in which a compression coil spring 97 is disposed to resiliently bias the diaphragm 95 against the atmospheric pressure applied on the upper surface of the diaphragm 95. The vacuum chamber 96 is provided with a vacuum inlet 98 connected to a first vacuum supply line 35 through which the vacuum chamber 96 is connected to the engine intake manifold. The valve member 94 is moved away from the port 93 when the vacuum pressure in the chamber 96 is decreased to cause the diaphragm 95 to be deformed by the spring 97 upwardly as viewed in the drawing.

The first air pressure supply controlling means 300 for controlling the supply of the air pressure from the air pump 2 into the first air pressure chamber 64 of the valve 6 also includes a first pressure delay valve 10 disposed in the first vacuum supply line 35.

The valve 10 comprises a valve housing 100 and a partition 101 extending across the interior of the housing 100 to divide the same into two chambers 102 and 103 which are always communicated with the engine intake manifold and the vacuum chamber 96 of the valve 9, respectively. The partition 101 forms thereon first and second orifices 104 and 105. A check valve 106 is provided for the second orifice 105 to permit air flow only from the chamber 103 through the second orifice to the chamber 102, although the first orifice 104 permits air flow therethrough in either direction. Thus, when the engine intake vacuum is suddenly decreased due to an abrupt acceleration of the engine operation wherein the throttle valve 12 is widely open, the decrease of the intake vacuum is transmitted to the vacuum chamber 96 of the valve 9 with a time delay because of the check valve 106 so that the vacuum pressure in the vacuum chamber 96 is maintained for a predetermined period of time after the vacuum in the engine intake system has been decreased. However, when the engine intake vacuum is increased, the increase is immediately transmitted through the pressure delay valve 10 to the vacuum chamber 96.

The supply of air pressure from the air pump 2 into the second air pressure chamber 65 of the air switching valve 6 is controlled by a second air pressure supply controlling means 400 which includes a change-over valve 11 disposed in the second control pressure line 32 and comprising a valve housing 111 defining therein two chambers 112 and 113 separated by a partition 114 and adapted to be communicated with each other by an opening 115 formed in the partition 114. The first chamber 112 is provided with a first port 116 substantially in axial alignment with the opening 115 and connected to the part of the line 32 connected to the secondary air supply line 3 at the point 34, and a second port 117 connected to the part of the line 32 connected to the second air pressure chamber 65 of the valve 6. The second chamber 113 is provided with a vacuum inlet port 118 connected by a second vacuum supply line 36 to the intake manifold of the engine 1. A changing-over valve member 119 is disposed in the chamber 112 for movement between a first position to close the opening 115 and open the port 116, as shown in the drawing, and a second position to close the port 116 and open the opening 115. It will be appreciated that, when the valve member 119 is in the position shown, the air pressure from the air pump 2 is fed through the line 32 and through the chamber 112 into the second chamber 65 of the valve 6. However, when the valve member 119 is in the second position to open the opening 115 and close the port 116, the second pressure chamber 65 of the valve 6 is communicated through the chamber 112 and 113 of the controlling means 400 and through the vacuum supply line 36 to the engine intake manifold. The valve member 119 is operatively connected by a valve stem 120 to a valve actuator which, in the illustrated embodiment of the invention, comprises a disphragm 121 which defines with the housing 111 a vacuum chamber 122 into which the engine intake vacuum in the vacuum supply line 36 is supplied through a branched vacuum line 37 connected at one end to the vacuum supply line 36 at a point 38 and at the other end to a vacuum inlet 123 of the vacuum chamber 122. A compression coil spring 124 is provided in the vacuum chamber 122 and tends to resiliently bias the diaphragm 121 against the force of the vacuum acting on the diaphragm 121.

The means 400 for controlling the supply of air pressure from the air pump 2 into the second air pressure chamber 65 of the valve 6 also includes a second pressure-delay valve 13 disposed in the second vacuum supply line 36. The valve 13 is substantially similar in construction and operation to the first pressure delay valve 10. Thus, it will be sufficient to note that parts of the valve 13 similar to those of the valve 10 are designated by similar reference numerals each followed by "a."

Numeral 14 designates a catalytic converter having oxidizing catalyst therein disposed in the exhaust pipe. Numeral 15 designates an electromagnetic three-way valve disposed in the vacuum supply line 35 for controlling the communication between the first and second pressure delay valves 10 and 13 and the intake manifold 1*b* of the engine in dependence on the temperature of the catalytic converter 14. For the purpose, a thermosensor 16 is disposed on the catalytic converter 14 to detect the temperature thereof and an electronic control circuit 17 is provided to actuate the electromagnetic valve 15 in accordance with the signal from the thermosensor 16.

When the temperature of the catalytic converter 14 is below a predetermined level, electric current is supplied to the coil 15*a* of the electromagnetic valve 15 to pull the plunger 15*b* thereof in the right direction in the drawing so that the opening 15*c* communicated to the atmosphere is closed and thereby the pressure delay valves 10 and 13 become in communication with the intake manifold of the engine 1.

The operation of the system described above will now be described when the temperature of the catalytic converter 14 is below the predetermined level. Assuming that the engine 1 is running at a substantially constant speed with the throttle valve 12 being partly open, the vacuum chamber 96 of the valve 9 is supplied with a sufficient vacuum pressure to move the valve member 94 toward and into engagement with the port 93 so that the first air pressure chamber 64 of the valve 6 is not connected to the seconary air supply line 3. The vaccum chamber 122 of the valve 11 is also supplied with a sufficient vacuum pressure to move the valve member 119 away from the valve seat of the port 116 so that the second air pressure chamber 65 of the valve 6 is connected to the secondary air supply line 3. The air pump 2 is discharging pressurized air at a constant pressure because the engine speed at this time is constant, as mentioned above. The first and second air pressure chambers 64 and 65 of the valve 6 are at the same pressure level because these chambers are communicated through the orifice 66. The first valve member 216 of the valve 6 is moved downwardly together with the third valve member 221 as viewed in the drawing by the force of the third spring 222 to close the opening 209 in the valve seat member 205 by the third valve member 221 and at the same time to open the opening 210 in the valve seat member 206, as shown in the drawing, so that the pressurized air from the air pump 2 flows through the port 214, the check valve 4 in the line 3 and the air injection manifold 5 into the exhaust manifold of the engine 1. The air pressure in the chamber 203 in the valve 6 is exerted to the second valve member 219. If the air pressure is larger than the pressure applied to the second valve member 219 by the initial spring force of the second coil spring 220, the valve member 219 is moved downwardly against the spring 220 to release the air through the opening 211 (air release aperture) in the valve seat member 207, through the chamber 204 and through the port 215 (air release port) into the atmosphere so that the secondary air in the line 3 is kept at a predetermined controlled pressure level.

When the throttle valve 2 is abruptly opened wide for the acceleration of the engine 1, the engine intake vacuum is descreased. In this case, however, the pressure delay valves 10 and 13 operate to transmit with a predetermined time delay the decrease of the engine intake vacuum to the vacuum chambers 96 and 122 of the valves 9 and 11 so that the respective valve members 94 and 119 are held in the positions shown for the predetermined time period after the occurence of the decrease in the intake manifold vacuum. In addition, the acceleration of the engine 1 causes an increase in the air pressure discharged from the air pump 2. The air pressure increase causes a pressure difference between the first and second air pressure chambers 64 and 65 of the valve 6. This pressure difference acts on the diaphragm 63 downwardly, as viewed in the drawing, and lasts for a predetermined time period which, in general, is equal to from several to more than 10 seconds and which is dependent on the diameter of the orifice 66 and the volume of the first air pressure chamber 64. When the pressure difference across the diaphragm 63 becomes larger than the force of the spring 69, the first valve member is moved further downwardly to close the opening 211 in the valve seat member 207. Therefore, even when the air pressure in the chamber 203 becomes higher than the predetermined value, which is determined by the spring 220, the opening 211 is not opened with a result that no air is released to the atmosphere therethrough. Accordingly, increased amount of the secondary air can be supplied to the exhaust manifold to advantageously purify the engine exhaust gases which contain increased amounts of CO and HC gases particularly at the initial stage of engine acceleration operation.

At the same time, when the air pressure in the chamber 202 becomes higher than the pressure applied to the third valve member 221 by the spring force of the third spring 222 during the above engine acceleration operation, the valve member 221 opens the opening 209 in the valve seat member 205 to release the air to the atmosphere through the opening 209, the chamber 201 and the port 212 so that the air pressure in the secondary air supply line 3 is kept at another predetermined value which is higher than that controlled by the second spring 220.

In the case where an engine acceleration operation is continued for a long time, the pressure levels in the vacuum chambers 96 and 122 in the valves 9 and 11 respectively become substantially equal to the atmospheric pressure after the lapse of a predetermined time period from the beginning of the engine acceleration. Thus, the valve member 94 of the first valve 9 is lifted by the spring 96 away from the port 93 so that the chamber 91 in the valve 9 now intercommunicates the first air pressure chamber 64 with the secondary air supply line 3. Simultaneously, the valve member 119 of the second valve 11 is moved by the spring 124 to close the port 116 so that the chamber 112 in the valve 11 now intercommunicates the second air pressure chamber 65 of the valve 6 and the intake manifold 1*b* of the engine 1. After the lapse of said predetermined time period from the beginning of the engine acceleration, therefore, the pressure in the first air pressure chamber 64 of the valve 6 becomes higher than the pressure in the second air pressure chamber 65 so that the diaphragm 63 is deformed upwardly as viewed in the drawing, when the sum of the pressure difference acting on the diaphragm 63 and the force of the spring 69 becomes larger than the force of the spring 222, to move the first valve member 216 into sealing engagement with the valve seat 206 of the partition wall to close the opening 210 and at the same time to move the third valve member 221 away from the valve seat 205 to open the opening 209 on the partition wall 205 with the result that all the air from the air pump 2 is released from the chamber 202 through the air release opening 209 in the valve seat member 205, the chamber 201 and through the air release port 212 into the atmosphere.

During an engine deceleration operation, the vacuum chambers 96 and 122 of the valves 9 and 11 are supplied with sufficient vacuum to maintain the valve members 94 and 119 in the positions shown, respectively. The pressure of the air discharged from the air pump 2 is decreased due to the decrease of the speed of the engine revolution with the result that a pressure difference is produced across the diaphragm 63. This pressure difference lasts for a predetermined time period and tends to deform the disphragm 63 upwardly as viewed in the drawing. In the case where the sum of the upward force produced by the pressure difference and the force of the spring 69 is greater than the force of the spring 222, the third valve member 221 will be moved upwardly to partly or fully open the air release opening 209 in the valve seat member 205 and at the same time the first valve memer 216 will be moved upwardly to partly or fully close the opening 210 so that either a part of or all of the air from the air pump 2 will be released through the opening 209, the chamber 201 and the air release port 212 into the atmosphere.

When the temperature of the catalytic converter 14 exceeds the predetermined level, current supply to the coil 15*a* of the electromagnetic valve 15 is stopped to shut off the communication between the pressure delay valves 10 and 13 and the engine intake manifold 1*b* and to communicate the valves 10 and 13 to the atmosphere.

The pressures in the respective pressure chambers 96 and 122 become the atmospheric pressure, so that the valve member 94 opens the port 93 while the valve member 119 closes the port 116 and opens the opening 115, respectively. Then, the air pressure in the secondary air supply line 3 is applied to the first air pressure chamber 64 of the valve 6 and the atmospheric pressure is applied to the second air pressure chamber 65 of the valve to produce the pressure difference across the diaphragm 63 of the valve 6.

The first and third valves 216 and 221 are thereby lifted upwardly against the spring 222 to respectively close the opening 210 and to open the opening 209 to release all the air from the air pump 2 to the atmosphere.

Since no secondary air is supplied to the exhaust manifold 1*a*, any substantial oxidation reactions may not proceed in the catalytic converter 14 thus decreasing the temperature of the catalytic converter 14 and preventing the thermal damage thereof.

The embodiment of the invention described above may have various modifications. For example, the air release port 212 or 215 can be connected by a hose or conduit to the air cleaner 1*c* to feed the released air back into the engine intake system. The orifice 66 in the diaphragm 63 can be replaced by a plurality of samll apertures or perforations formed in the diaphragm. A filter can be provided for the orifice 66 to protect the same against foreign particles. The volume of the second air pressure chamber 65 of the air switching valve 6 can be increased by providing a container outside the second housing part 62 of the valve and by pneumatically connecting the container to the chamber 65. The electromagnetic valve 15 provided in the vacuum supply line 35 between the engine intake manifold and the pressure delay valves 10 and 13 can be opened or closed in accordance with another engine operation parameter such as the temperature of the engine cooling water, for example. Each of the valve actuators of the valves 9 and 11, which have been described and illustrated as comprising diaphragms 95 and 121, respectively, can be replaced by an electric valve control unit comprising a solenoid operatively associated with the valve member 94 and 119 and an electric switch responsive to variation in the vacuum pressure from the pressure delay valve 10 or 13 to electrically energize or deenergize the solenoid for the actuation of the valve member.

What is claimed is:

1. A secondary air supply system for an internal combustion engine, comprising:

an air pump adapted to be driven by an engine;

a secondary air supply line extending between said air pump and the engine exhaust system;

valve means in said secondary air supply line for controlling the secondary air supply from said air pump into said engine exhaust system;

a valve actuator operatively associated with said valve means and comprising first and second air pressure chambers, a diaphragm between said air pressure chambers, a first spring member disposed in said first air pressure chamber to yieldably act on said diaphragm and restricted passage means intercommunicating said first and second air pressure chambers;

a first control pressure line through which the air pressure produced by said air pump is adapted to be supplied into said first air pressure chamber;

first controlling means in said first control pressure line for controlling the air pressure supply to said first air pressure chamber;

a second control pressure line through which the air pressure produced by said air pump is adapted to be supplied into said second air pressure chamber; and second controlling means in said second control pressure line for controlling the air pressure supply to said second air pressure chamber;

wherein said valve means includes:

a valve housing defining therein a generally cylindrical space;

first to third partition walls disposed in said space to divide in into first to fourth chambers, said partition walls having respective first to third openings to communicate the opposed chambers with each other, said first and fourth chambers being communicated to the atmosphere, and said valve housing having air inlet and outlet respectively communicating said second and third chambers with said air pump and said engine exhaust system;

a first valve member disposed in said third chamber and operatively connected to said diaphragm of said valve actuator for movement thereby to control the communication between said second and third chambers as well as the communication between said third and fourth chambers;

a second valve member disposed in said fourth chamber and a second spring member for biasing said second valve member toward said third opening of said third partition wall to close the same when the air pressure in said third chamber is smaller than the force of said second spring; and a third valve member disposed in said first chamber and a third spring for biasing said third valve member toward said first opening of said first partition wall to close the same when the air pressure in said second chamber is smaller than the force of said third spring, said third valve member being linked to said first valve member in such a manner that said third valve member is moved away from said first opening to open the same when the movement of said first valve member toward said second opening of said second partition wall exceeds a predetermined stroke, said first controlling means being operative to interrupt the supply of the air pressure into said first air pressure chamber while said second controlling means being operative to supply the air pressure into said second air pressure chamber at least at the initial stage of an engine acceleration operation whereby said first valve member is driven toward said third opening to close the same to thereby supply an increased amount of secondary air to said engine exhaust system.

2. A second air supply system according to claim 1, wherein the spring force of said third spring is larger than that of said first spring.

3. A secondary air supply system according to claim 1, wherein said third valve member opens said third opening of said third partition wall when the air pressure in said second chamber exceeds the spring force of said third spring to release the air from said second chamber to the atmosphere during a time when said first valve member closes said first opening.

4. A secondary air supply system according to claim 1, wherein when said engine acceleration operation is continued for more than a predetermined time period, said first controlling means is operative to supply the air pressure into said first air pressure chamber while said second controlling means being operative to interrupt the supply of the air pressure into said second air pressure chamber, whereby said first valve member is driven toward said second opening to close the same, and at the same time said third valve member is moved away from said first opening to open the same so as to release all the air from said air pump into the atmosphere.

5. A secondary air supply system according to claim 1, wherein said first controlling means comprise a third valve housing provided with first and second ports pneumatically connected to said secondary air supply line upstream of said valve means and to said first air pressure chamber of said valve actuator, a fourth valve member disposed in said third valve housing for movement to control the communication between said first air pressure chamber and said secondary air supply line, a first vacuum-responsive valve actuator operatively associated with said fourth valve member and responsive to variation of the engine intake vacuum to actuate said fourth valve member, said first vacuum-responsive valve actuator comprising a second diaphragm cooperative with said third valve housing to define a first vacuum chamber pneumatically connected to said engine intake system and a fourth spring member operative to move said fourth valve member so that said first air pressure chamber is communicated with said secondary air supply line when the vacuum pressure in said first vacuum chamber is decreased substantially to the atmospheric pressure, and a first pressure delay valve means operative to transmit with a predetermined time delay a decrease of the engine intake vacuum to said first vacuum chamber, and wherein said second controlling means comprise a fourth valve housing provided with third and fourth ports pneumatically connected to said secondary air supply line upstream of said valve means and to said second air pressure chamber of said valve actuator, respectively, and a fifth port pneumatically connected to the engine intake system, a fifth valve member disposed in said fourth valve housing for movement between said third and fourth ports to change-over the communication of said second air pressure chamber of said valve actuator with said secondary air supply line and with said engine intake system, a second vacuum-responsive valve actuator operatively associated with said fifth valve member and responsive to variation of the engine intake vacuum to actuate said fifth valve member, said second vacuum-responsive valve actuator comprising a third diaphragm cooperative with said fourth valve housing to define a second vacuum chamber pneumatically connected to said engine intake system and a fifth spring member operative to move said fifth valve member so that said second air pressure chamber is communicated with said engine intake system but not with said secondary air supply line when the vacuum pressure in said second vacuum chamber is decreased substantially to the atmospheric pressure, and a second pressure delay valve means operative to transmit with a predetermined time delay a decrease of the engine intake vacuum to said second vacuum chamber.

* * * * *